US007306396B1

(12) United States Patent
Chen

(10) Patent No.: US 7,306,396 B1
(45) Date of Patent: Dec. 11, 2007

(54) CONNECTOR STRUCTURE WITH A DETACHABLE MOUNTING TUBE

(76) Inventor: Bo Shen Chen, No.33-33, Lane 320, Sec. 1, Shatian Rd., Dadu Township, Taichung County 432 (TW)

( * ) Notice: Subject to any disclaimer, the term of this patent is extended or adjusted under 35 U.S.C. 154(b) by 0 days.

(21) Appl. No.: 11/463,023

(22) Filed: Aug. 8, 2006

(51) Int. Cl.
*B25B 3/16* (2006.01)

(52) U.S. Cl. ..... 403/327; 81/177.85; 81/438; 279/74; 279/82; 403/322.1

(58) Field of Classification Search ..... 403/322.1, 403/322.3, 322.4, 325, 327; 81/177.85, 438, 81/451, 429; 279/74, 82
See application file for complete search history.

(56) References Cited

U.S. PATENT DOCUMENTS 2,728,895 A * 12/1955 Quackenbush et al. ..... 439/321
2,829,685 A * 4/1958 Mitchell et al. ..... 81/451
3,260,541 A * 7/1966 Sadler et al. ..... 403/325
3,298,410 A * 1/1967 Morifuji ..... 81/458
4,140,161 A * 2/1979 Russo et al. ..... 81/451
4,197,886 A * 4/1980 MacDonald ..... 81/442
4,237,946 A * 12/1980 Leitner ..... 81/429
4,692,073 A * 9/1987 Martindell ..... 408/239 A
5,062,749 A * 11/1991 Sheets ..... 279/75
5,333,523 A * 8/1994 Palm ..... 81/177.85
5,341,708 A * 8/1994 Nick ..... 81/451
5,447,397 A * 9/1995 Asano ..... 408/59
5,586,847 A * 12/1996 Mattern et al. ..... 408/239 A
5,678,961 A * 10/1997 Fleege et al. ..... 408/239 A
5,682,800 A * 11/1997 Jore ..... 81/429
5,692,851 A * 12/1997 Pace ..... 403/31
5,992,274 A * 11/1999 Lammers ..... 81/451
5,996,452 A * 12/1999 Chiang ..... 81/429
6,192,776 B1 * 2/2001 Leitner ..... 81/429
6,199,872 B1 * 3/2001 Hasan ..... 279/30
6,530,299 B1 * 3/2003 Liu ..... 81/451
6,668,941 B2 * 12/2003 Phillips et al. ..... 173/93.5
6,929,266 B2 * 8/2005 Peters et al. ..... 279/82
6,953,196 B1 * 10/2005 Huang ..... 279/75
7,096,768 B1 * 8/2006 Chen ..... 81/438
7,159,493 B1 * 1/2007 Huang ..... 81/438
7,175,184 B1 * 2/2007 Rinner et al. ..... 279/43
2003/0145693 A1 * 8/2003 Huang ..... 81/438
2004/0188959 A1 * 9/2004 Chen ..... 279/82
2005/0016333 A1 * 1/2005 Compton ..... 81/177.85
2005/0045001 A1 * 3/2005 Huang ..... 81/177.85
2005/0166725 A1 * 8/2005 Chen ..... 81/451
2006/0048613 A1 * 3/2006 Abel et al. ..... 81/177.2
2006/0230887 A1 * 10/2006 Taguchi ..... 81/451
2006/0278050 A1 * 12/2006 Hsiao ..... 81/451

* cited by examiner

*Primary Examiner*—Daniel P. Stodola
*Assistant Examiner*—Joshua T Kennedy
(74) *Attorney, Agent, or Firm*—Banger Shia

(57) ABSTRACT

A connector structure with a detachable mounting tube comprises a mounting pipe with an inner sliding pipe detachably secured to an end of a connector. The connector structure not only can be provided for insertion of an ordinary screwdriver head to carry out screwing and unscrewing operation. Further, when the mounting tube is detached from the connector, a special tool head with a big head and a short length can also be inserted in the connector, thus overcoming the conventional technique bottleneck of needing two different connectors. Besides, the mounting tube is detachable from the connector, for the sake of simplification, the sliding pipe and the mounting tube are integral with each other.

3 Claims, 9 Drawing Sheets

CONNECTOR STRUCTURE WITH A DETACHABLE MOUNTING TUBE

BACKGROUND OF THE INVENTION

1. Field of the Invention

The present invention relates to a connector structure with a detachable mounting tube, and more particularly to a connector structure used on a power tool for insertion of an ordinary screwdriver head or a special tool head.

2. Description of the Prior Art

FIG. 1, (TW Pat. No. 093205513) shows a conventional connector used on a power tool for insertion of screwdriver head, and the connector comprises a shaft 11 slideably installed in a mounting tube 10. The shaft 11 has a connecting end 111 to be coupled to the power tool, and an inserting hole 112 is formed in another end surface of the shaft 11 for insertion of a screwdriver head 12. A first magnetic member 13 is disposed in the bottom of the inserting hole 112, and a second magnetic member 14 is located at the another end of the mounting tube 10. The screwdriver head 18 can be secured in the inserting hole 112 by the magnetic force of the first magnetic member 13, and the magnetic force of the second magnetic members 14 serves to hold the screw 15 to be rotated by the screwdriver head 18.

It is to be noted that the conventional connector structure can be provided for insertion of various types of screwdriver head, and the magnetic force can prevent the screw from falling off during the screwing and unscrewing operation. However, as shown in FIG. 2, for a special tool head 16 with a large head and a short length, it must employ another conventional clamping device 17 since the above-mentioned conventional connector structure is not suitable for this special tool head 16.

Therefore, the user has to prepare a clamping device and a connector simultaneously during work, this is not only troublesome but also money wasted.

The present invention has arisen to mitigate and/or obviate the afore-described disadvantages.

SUMMARY OF THE INVENTION

The primary objective of the present invention is to provide a connector structure with a detachable mounting tube, wherein a mounting tube with an inner sliding pipe is detachably secured to an end of a connector. The connector structure can be provided for insertion of the ordinary screwdriver head by the use of the connector, and is also suitable for insertion of the special tool head when the mounting tube is removed from the connector structure.

DETAILED DESCRIPTION OF THE PREFERRED EMBODIMENTS

Figure 1:
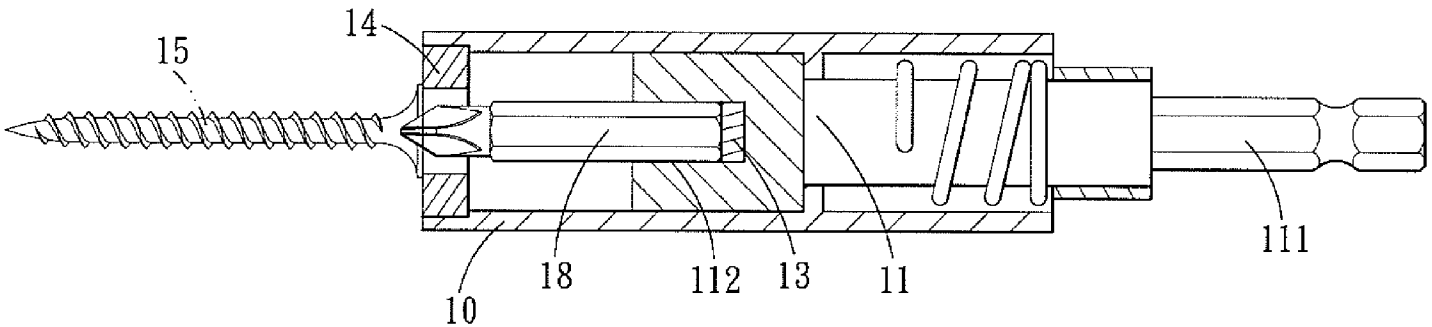
FIG. 1 PRIOR ART
FIG. 1 is a cross sectional and operational view of showing a conventional screwdriver head connector.
Figure 2:
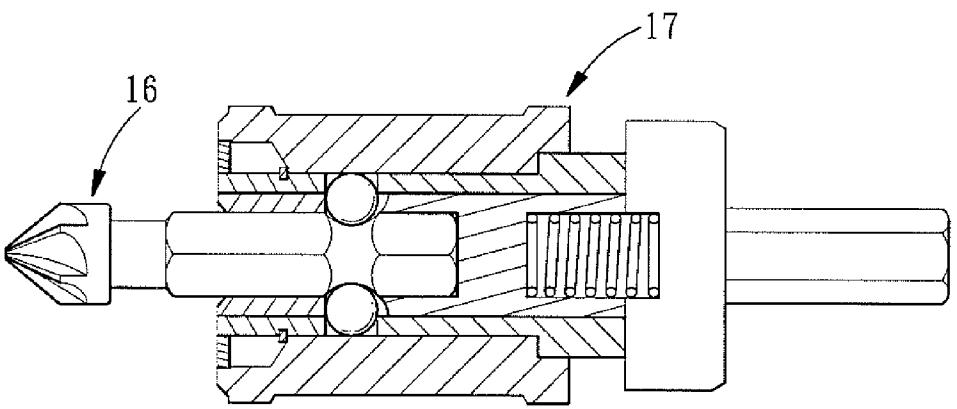
FIG. 2 PRIOR ART
FIG. 2 is a cross sectional view of showing a conventional clamping device for clamping a tool head.
Figure 3:
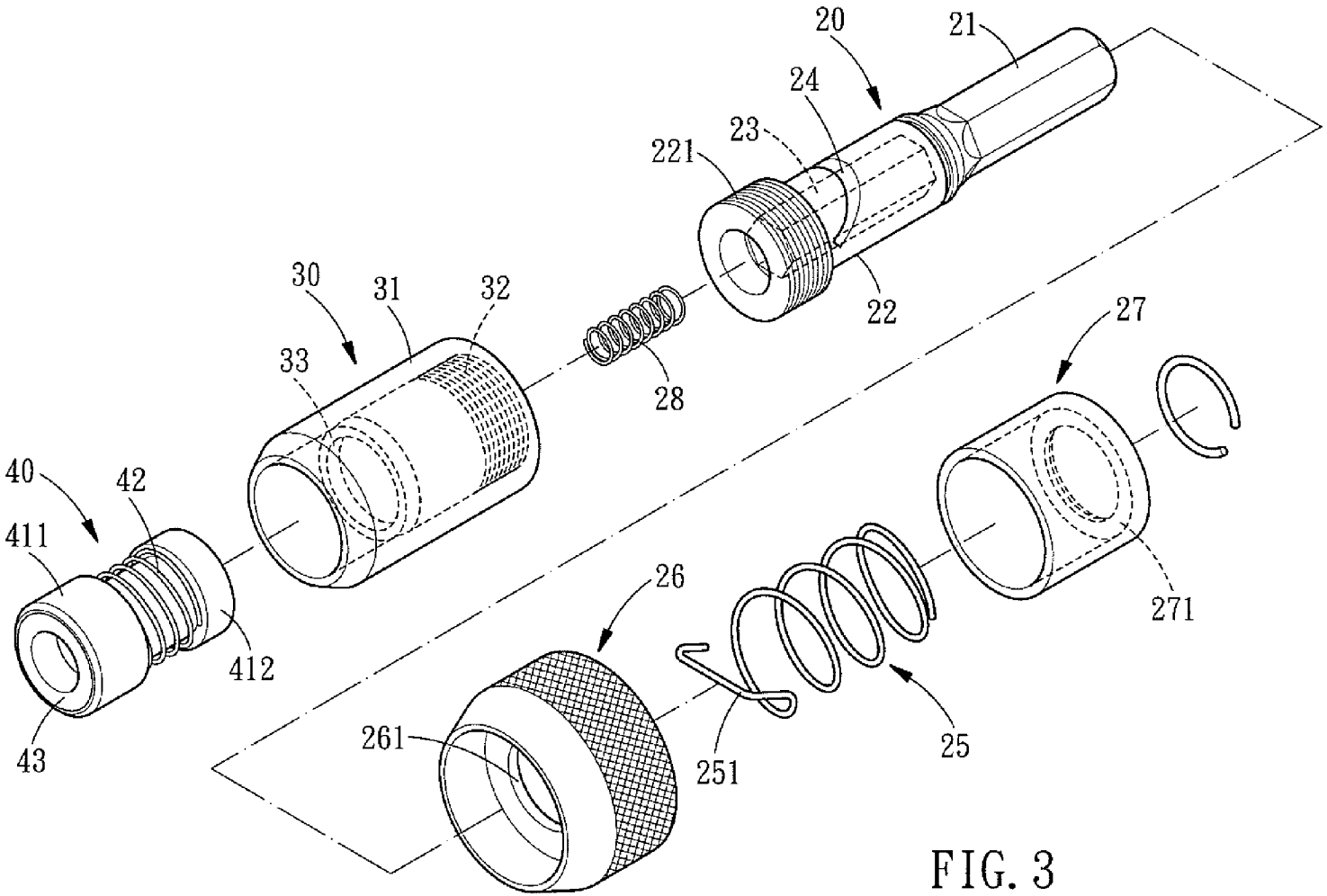
FIG. 3 is an exploded view of a connector with a detachable mounting pipe in accordance with the present invention.
Figure 4:
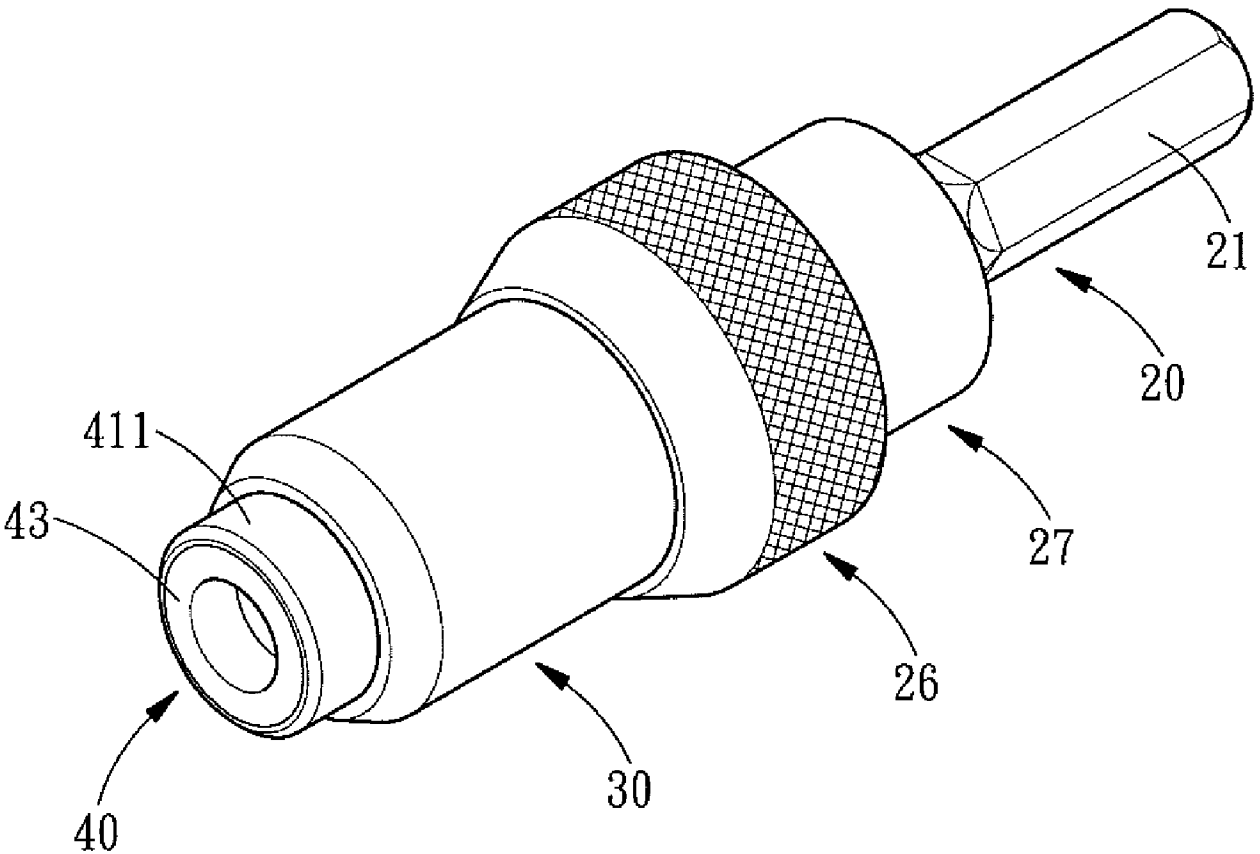
FIG. 4 is an assembly view of the connector with a detachable mounting pipe in accordance with the present invention.
Figure 5:
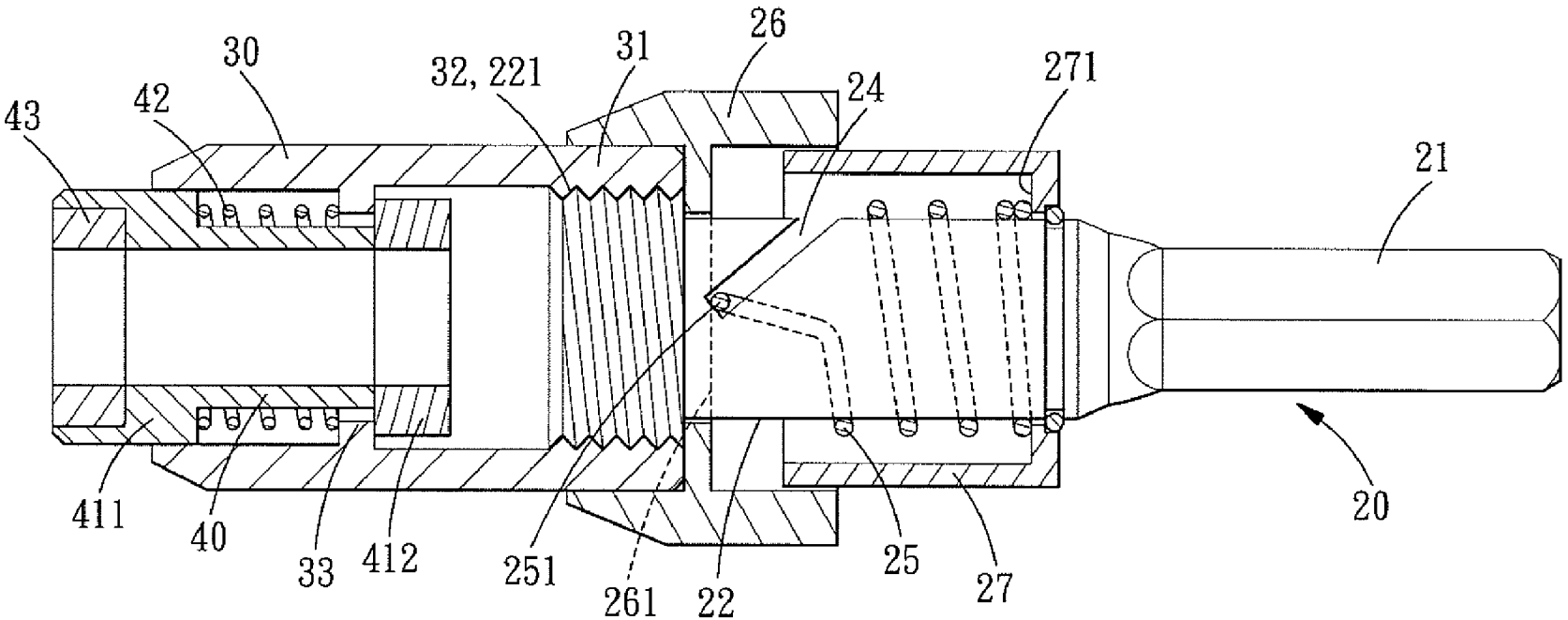
FIG. 5 is a cross sectional view of the connector with a detachable mounting pipe in accordance with the present invention.

The present invention will be more clear from the following description when viewed together with the accompanying drawings, which show, for purpose of illustrations only, the preferred embodiment in accordance with the present invention.

Referring to FIGS. 3-6, a connector structure with a detachable mounting tube in accordance with a preferred embodiment of the present invention is suitable for insertion of both a screwdriver head 501 and a special tool head 502, and comprises: a connector 20, a mounting tube 30 detachably disposed at an end of the connector 20, and a sliding pipe 40 slideably installed in the mounting tube 30.

The connector 20 has a coupling end 21 to be coupled to a power tool and has a connecting end 22. A plurality of threads 221 is formed in the outer periphery of the connecting end 22, an inserting hole 23 for insertion of the tool head 502 is formed in the connecting end 22, and the inserting hole 23 can be hexagonal in cross section, so it is suitable for insertion of a hexagonal tool head 502.

In order that the conventional type screwdriver head 501 with a locking groove 511 or the special tool head 502 can be positioned firmly, and the screwdriver head 501 can be bounced out of the inserting hole 23 when the user wants to take the screwdriver head 501 out of the inserting hole 23, a chute 24 is formed in the outer periphery of the connector 20 and located correspondingly to the inserting hole 23. An elastic member 25 is mounted on the outer periphery of the connector 20 in such a manner that an abutting end 251 of the elastic member 25 is horizontally inserted into the chute 24. And then a sliding sleeve 26 is mounted onto the connector 20 in such a manner that the inner end surface 261 of the sliding sleeve 26 abuts against the abutting end 251. A tube 27 is mounted on the connector 20 and is located adjacent to the sliding sleeve 26, and an abutting surface 271 formed at an end of the sliding sleeve 27 abuts against another end of the elastic member 25. A spring 28 is disposed at the bottom of the inserting hole 23 of the connector 20.

The mounting tube 30 has a connecting end 31, a plurality of threads 32 for meshing with the threads 221 is formed in the inner surface of the mounting tube 30 and is located at the connecting end 31, so as to enable the connecting end 31 to be connected to the connecting end 22 of the connector 20. An annular rib 33 is formed in the inner surface of the mounting tube 30.

The sliding pipe 40 is formed at either end thereof with a flange 411, 412, and is received in the mounting tube 30, and the two flanges 411, 412 are located at both sides of the annular rib 33. The flange 411 protrudes out of the mounting tube 30, so that the mounting tube 30 can slide within the tube 27, and a spring 42 is biased between the flange 411 and the annular rib 33. A magnetic member 43 with a central hole is disposed in the end of the sliding pipe 40 protruding out of the mounting tube 30.

The connector structure of the present invention can be provided for insertion of the ordinary screwdriver head 501 when equipped with the connector 20, and is also suitable for insertion of the special tool head 502 when the mounting tube 30 is removed.

For a better understanding of the present invention, its operation and function, reference should be made to FIGS. 3-5 again. After the connector 20, the mounting tube 30, and the sliding pipe 40 after assembled together, the present invention can be provided for insertion of the ordinary screwdriver head 501. In the normal state, the abutting end 251 of the elastic member 25 keeps pushing against the inner end surface 261 of the sliding sleeve 26, and the sliding sleeve 26 is located at the top end of the connector 20. At this moment, the elasticity of the elastic member 25 will make the abutting end 251 protrudes out of the chute 25 and partially into the inserting hole 23.

Figure 7:
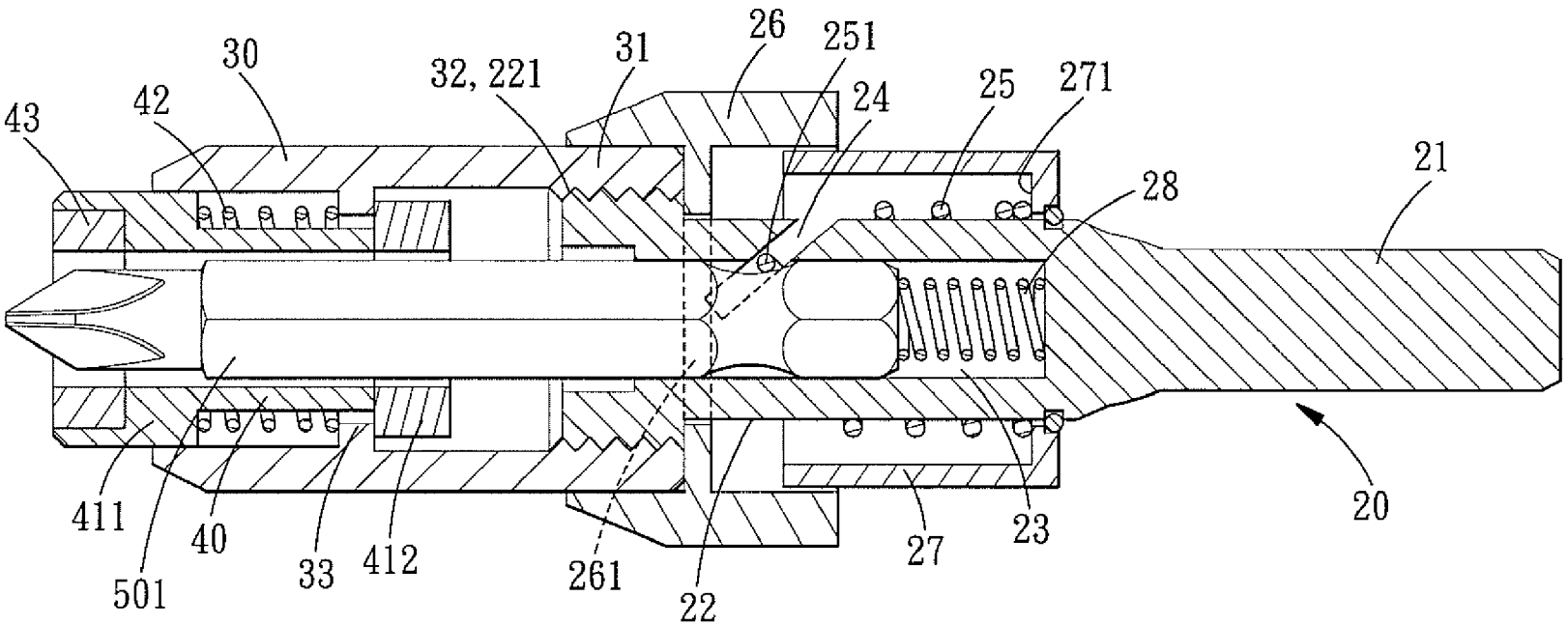
FIG. 7 is a cross sectional view in accordance with the present invention of showing that a screwdriver head is being inserted in the connector structure.

As shown in FIG. 7, when inserting the screwdriver head 501 with the locking groove 511 into the inserting hole 23, the end of the screwdriver head 501 will press against the spring 28. When the locking groove 511 is aligned to the chute 24, the abutting end 251 will be engaged with the locking groove 511 of the screwdriver head 501. At this moment, the end of the screwdriver head 501 is pushed by the spring 28, meanwhile, the abutting end 251 of the elastic member 25 is engaged in the locking groove 511 to stop the movement of the screwdriver head, thus preventing the screwdriver head 501 from disengaging out of the inserting hole 23.

Figure 8:
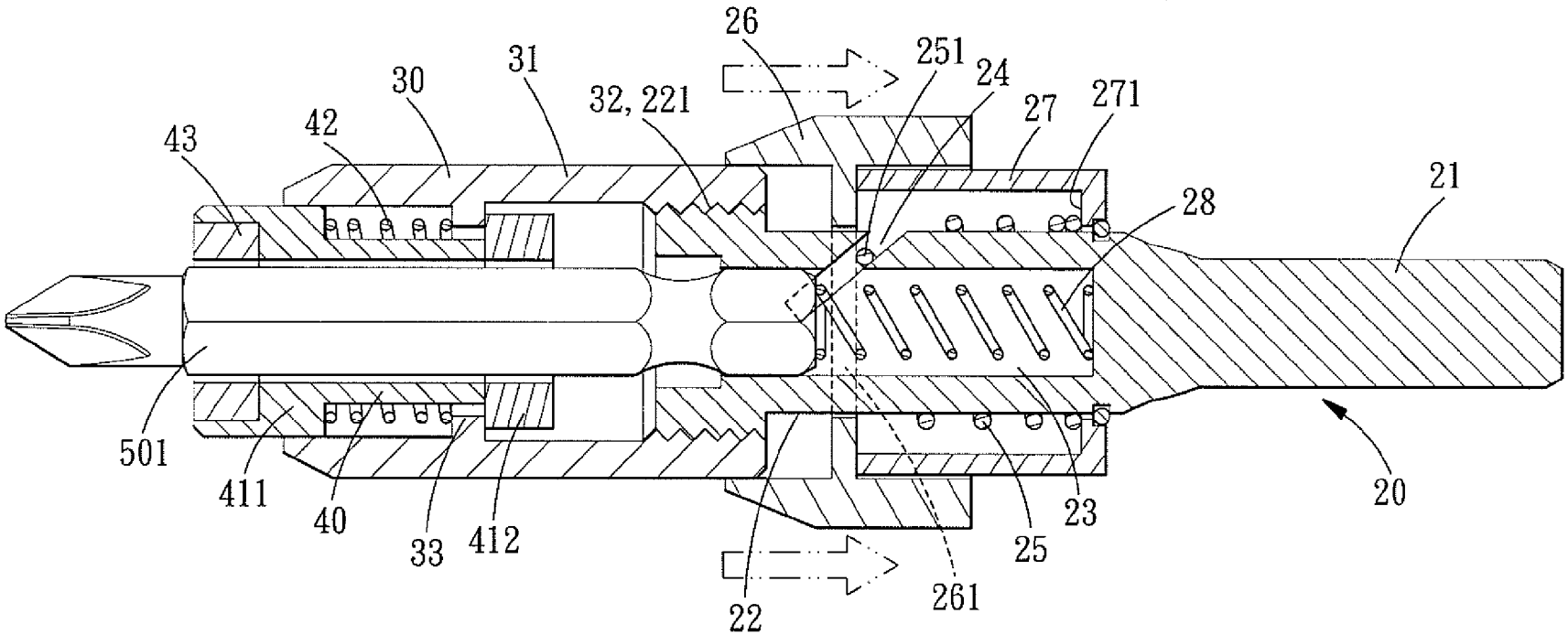
FIG. 8 shows how to take the screwdriver head out of the connector structure.

Referring then to FIG. 8, after the screwdriver head 501 is inserted in the inserting hole 23 of the connector 20, it can be used to do the screwing and unscrewing operation. When the end of the screwdriver head 501 is in contact with the screw, the magnetic member 43 of the sliding pipe 40 will attract the screw, and drive the sliding pipe 40 to move toward the screw, thus preventing the screw from falling off during the screwing and unscrewing operation.

Figure 9:
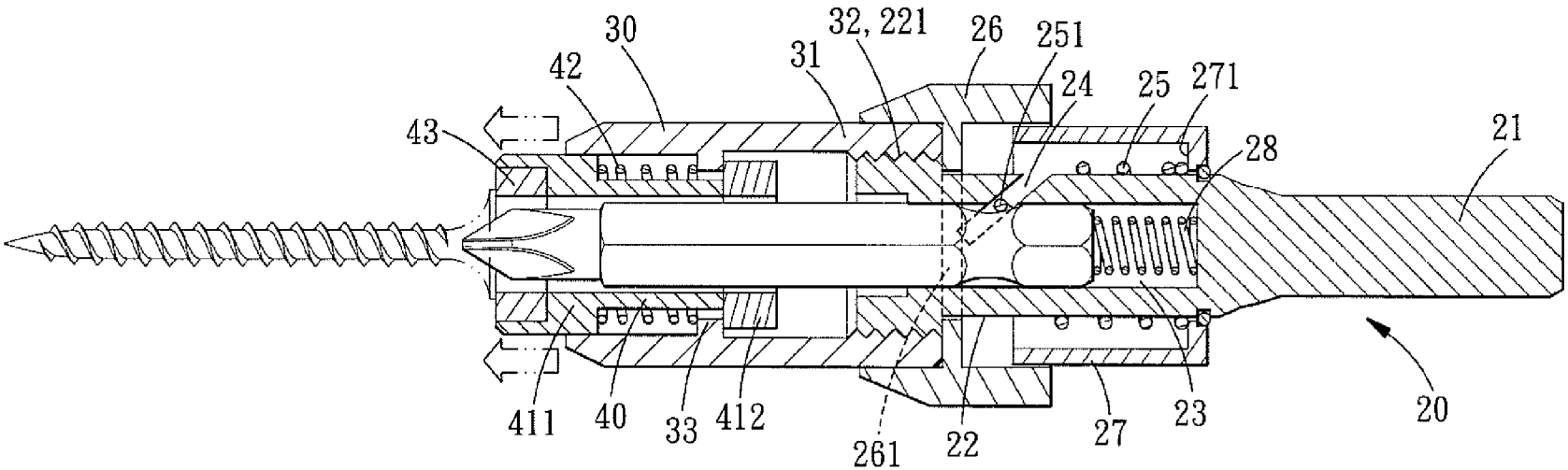
FIG. 9 is a cross sectional illustrative view in accordance with the present invention of showing the screwdriver head inserted in the connector structure is rotating a screw.

Referring to FIG. 9, the screwdriver head 501 can be disassembled from the connector structure by pushing the sliding sleeve 26 toward the tube 27, meanwhile, the inner end surface 261 of the sliding sleeve 26 will push the abutting end 251 out of the chute 24 and the locking groove 511 of the screwdriver head 501. At this moment, the spring 28 will push the screwdriver head 501 out of the inserting hole 23. It is to be noted that the sliding pipe 40 is specially provided with the magnetic member 43, the magnetic force of the magnetic member 43 can prevent the screwdriver head 501 from bouncing excessively out of the inserting hole 23. in other words, after the abutting end 251 is disengaged from the locking groove 511 of the screwdriver head 501, the screwdriver head 501 will be disengaged out of the inserting hole 23 but will not move completely out of the sliding pipe 40, and this design prevents the falling off of the screwdriver head 501.

Figure 10:
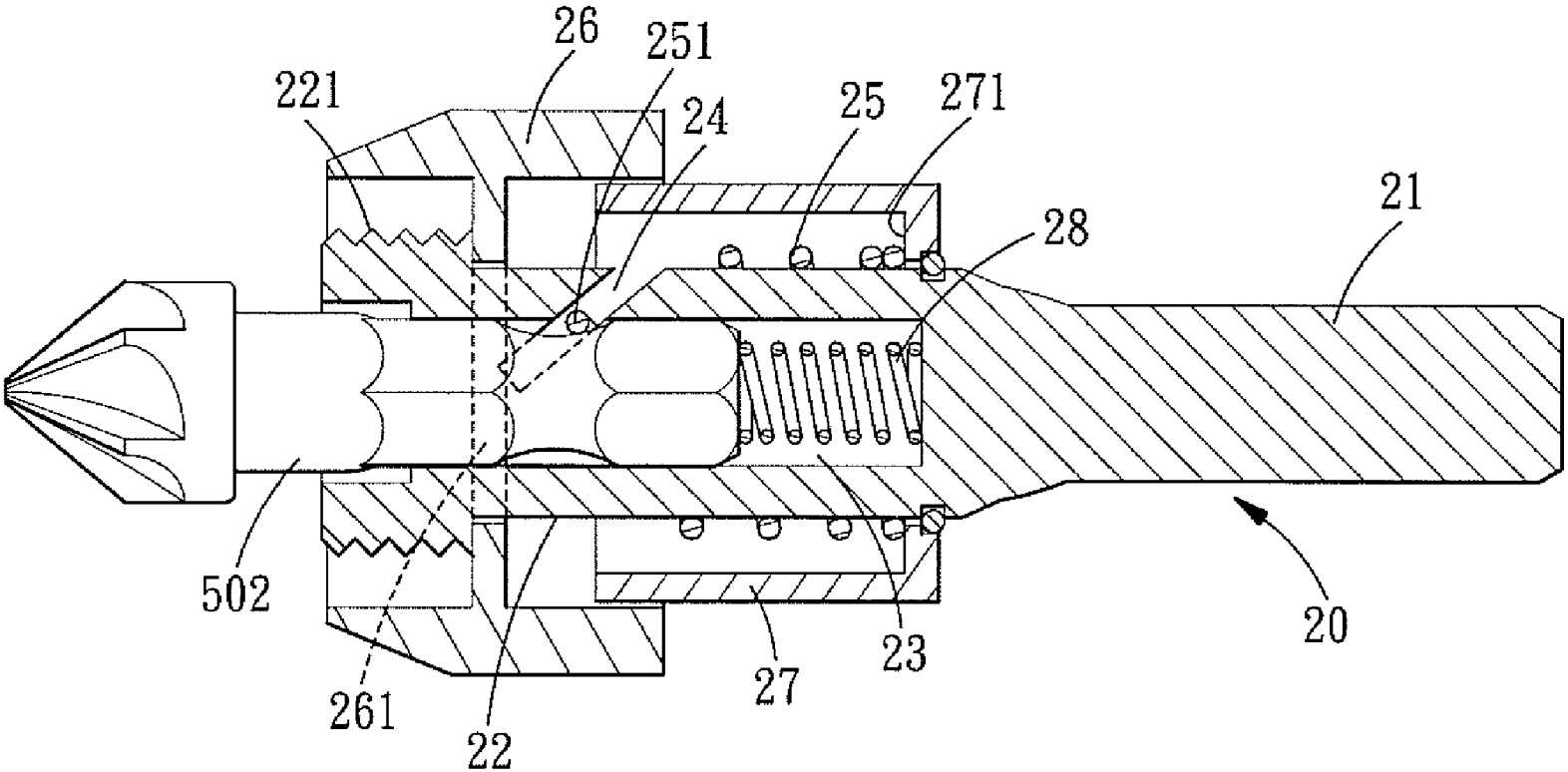
FIG. 10 is a cross sectional view in accordance with the present invention of showing that a tool head is being inserted in the connector structure.

Referring finally to FIG. 10, if the work head to be inserted is the special tool head 502 with a comparatively large head and a short length, the mounting pipe 30 and the sliding pipe 40 are compatible with the tool head 502. Since the mounting pipe 30 is detachably secured to the connector 20, the tool head 502 can be inserted directly into the connector 20.

Figure 6:
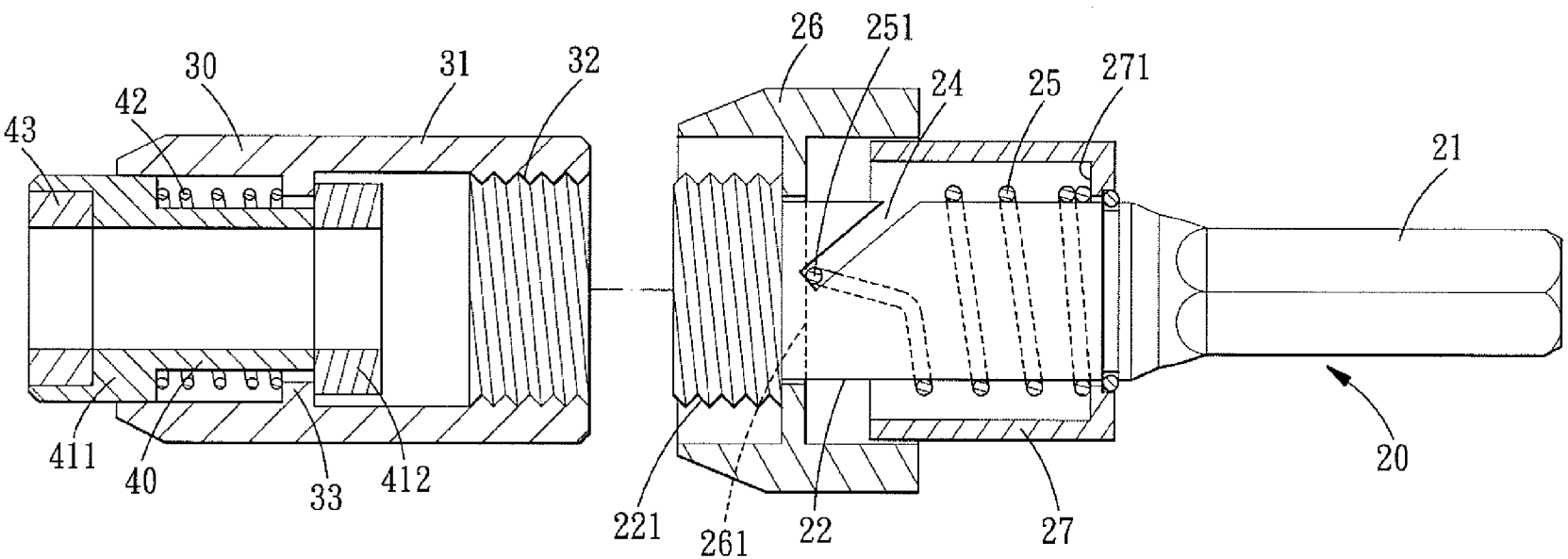
FIG. 6 is a cross sectional view of showing the connector with a detachable mounting pipe in accordance with the present invention, wherein the mounting tube is detached from the connector.

It is to be noted that, as shown in FIG. 6, the mounting pipe 30 can be detached from the connector 20, and the sliding pipe 40 can be integral with the mounting pipe 30.

The connector structure of the present invention can be provided for insertion of the ordinary screwdriver head 501 when equipped with the connector 20, and is also suitable for insertion of the special tool head 502 when the mounting tube 30 is removed.

While we have shown and described various embodiments in accordance with the present invention, it is clear to those skilled in the art that further embodiments may be made without departing from the scope of the present invention.

What is claimed is:

1. A connector structure comprising:

a connector having a coupling end to be coupled to a power tool and having a connecting end, an inserting hole for insertion of a tool head being formed in the connecting end;

a detachable mounting tube having a connecting end to be connected to the connecting end of the connector, a rib being formed in an inner surface of the mounting tube;

a sliding pipe being formed at each end thereof with a flange and being received in the mounting tube in such a manner that the two flanges are located at both sides of the rib, and one of the two flanges protrudes out of the mounting tube, so that the sliding pipe can slide within the tube and around said tool head, and a magnetic member for engaging a fastener to be driven by said tool head and having a central hole, the magnetic member being disposed in the end of the sliding pipe protruding out of the mounting tube; and a spring located between the flange protruding out of the mounting tube and the rib of the mounting tube for biasing the flange protruding out of the mounting tube away from the rib.

2. The connector structure as claimed in claim 1, wherein a chute is formed in an outer periphery of the connector and located correspondingly to the inserting hole, an elastic member is mounted on the outer periphery of the connector in such a manner that an abutting end of the elastic member is horizontally inserted into the chute, and then a sliding sleeve is mounted onto the connector in such a manner that an inner end surface of the sliding sleeve abuts against the abutting end, a tube is mounted on the connector and is located adjacent to the sliding sleeve, and an abutting surface formed at an end of the sliding sleeve abuts against another end of the elastic member, a spring is disposed at a bottom of the inserting hole of the connector.

3. The connector structure as claimed in claim 1, wherein a plurality of threads is formed in an outer periphery of the connecting end of the connector, and a plurality of threads for meshing with the threads in the outer periphery of the connecting end of the connector is formed in the inner surface of the mounting tube and is located at the connecting end of the mounting tube, so as to enable the connecting end of the mounting tube to be connected to the connecting end of the connector.

* * * * *